US007275404B1

(12) United States Patent
Chang et al.

(10) Patent No.: US 7,275,404 B1
(45) Date of Patent: Oct. 2, 2007

(54) METHOD AND AN APPARATUS TO CONTROL THE LATERAL MOTION OF A LONG METAL BAR BEING FORMED BY A MECHANICAL PROCESS SUCH AS ROLLING OR DRAWING

(75) Inventors: Tzyy-Shuh Chang, Ann Arbor, MI (US); Hsun-Hau Huang, Ann Arbor, MI (US); Chang-Hung Lin, Ann Arbor, MI (US)

(73) Assignee: OG Technologies, Inc., Ann Arbor, MI (US)

( * ) Notice: Subject to any disclaimer, the term of this patent is extended or adjusted under 35 U.S.C. 154(b) by 0 days.

(21) Appl. No.: 11/284,508

(22) Filed: Nov. 22, 2005

(51) Int. Cl.
*B21B 39/20* (2006.01)
*B21B 39/26* (2006.01)

(52) U.S. Cl. ..... 72/250; 226/189; 226/196.1; 72/428; 242/615.1; 242/615.2

(58) Field of Classification Search ..... 72/250, 72/251, 428; 226/189, 196.1; 242/615.1, 242/615.2
See application file for complete search history.

(56) References Cited

U.S. PATENT DOCUMENTS 3,014,628 A 12/1961 Littlehale
3,793,868 A * 2/1974 Wilson ..... 72/226
4,121,446 A * 10/1978 Passoni et al. ..... 72/238
4,343,167 A * 8/1982 Hasegawa et al. ..... 72/10.7
4,413,494 A 11/1983 Gilvar et al.
4,559,990 A 12/1985 Greilinger et al.
4,635,861 A 1/1987 Resch
5,743,127 A * 4/1998 Takeda et al. ..... 72/250
6,920,772 B1 7/2005 Shore et al.

* cited by examiner

*Primary Examiner*—Dmitry Suhol
(74) *Attorney, Agent, or Firm*—Dykema Gossett PLLC

(57) ABSTRACT

An adjustable guide, includes two or more mechanisms each having a rotatable retaining element containing a retaining groove with a variable radius in its perimeter surface. The grooves form a guidance path to control the lateral, i.e. non-axial, motion of a long bar moving along a longitudinal axis during a production process.

The diameter of the guidance path varies according to the variable radii of the grooves. The guidance path increases in size at a predetermined rate, from a point of origin to an end point on the retaining groove. Rotating the retaining elements causes the diameter of the retaining grooves to change so that the size of the guidance path can be changed to match the diameter of the bar being rolled, size of the guidance path can be changed to fit the diameter of a new bar rolled without having to exchange the guide for a different sized guide, reduce fiction between the bar and the guide, a media, such as compressed air, can be injected between the retaining elements via orifices.

Each retaining element is attached to a mounting apparatus. The mounting apparatus can be fixed or flexible. The flexible mounting apparatus includes one or more springs and one or more shock absorbers. A force neutral position of the flexible mounting apparatus is designed to be located on the predetermined ideal bar path line. The flexible mounting apparatus dissipates kinetic energy from the bar thereby reducing the bar's lateral motion relative to the ideal bar path line.

The damping ratio of the mounting apparatus can be adjustable to alter the product's vibration mode to enable better control of the bar's lateral motion.

26 Claims, 11 Drawing Sheets

PRIOR ART (b)

METHOD AND AN APPARATUS TO CONTROL THE LATERAL MOTION OF A LONG METAL BAR BEING FORMED BY A MECHANICAL PROCESS SUCH AS ROLLING OR DRAWING

STATEMENT REGARDING FEDERALLY FUNDED RESEARCH

This invention was made with United States government support under Cooperative Agreement No. DE-FC36-GO14003 "SQA™ SURFACE QUALITY ASSURED STEEL BAR PROGRAM" awarded by the Department of Energy. The United States government has certain rights in the invention.

CROSS-REFERENCE TO RELATED APPLICATIONS

N/A.

BACKGROUND OF THE INVENTION

1. Related Field

The present invention relates generally to a device to control the motion of a long product, such as a steel bar or rod, moving with high linear speed, in a manufacturing process, such as rolling.

2. Background of the Invention

Certain manufacturing processes, such as rolling, drawing and extrusion are utilized to reduce the cross sectional dimensions of metal products through mechanical contact between the metal workpiece and different tools such as rolls and dies. These manufacturing processes are continuous, or substantially continuous, processes and are herein collectively referred to as "reducing processes." This invention applies to metal products that are commonly referred to as long products or bars and/or rods. These metal products move along a longitudinal axis in a manufacturing process and will be referred to hereinafter as a "bar" or "bars."

A bar is different than a metal slab, bloom or strip, all of which are known as flat products. The cross section of a bar has a smaller circumference/cross-section-area ratio than flat products and the bar may rotate/twist about its longitudinal axis while moving forward longitudinally. The bar shapes shown in FIG. 2, for example, have a ratio of circumference to cross-section equal to or smaller than 4.25 when the cross sectional area is unity for the given shape. The shapes of the cross-section of a metal bar shown in FIG. 2 include round, oval, or polygonal.

In the hot rolled steel industry, the length to circumference ratio of the bar after it is reduced is typically over 10 and the length to cross-section critical dimension, such as the diameter of a round bar, is over 30. Furthermore, the bar frequently travels through the reducing process at high speed and high temperature.

The manufacturing process is designed to move the bar along a predetermined, ideal path line (herein referred to as the "bar path") through various reducing mechanisms that apply the appropriate mechanical reducing forces to the bar in a controlled, consistent manner. It is desirable to constrain the bar to the bar path by controlling the bar's non-axial motion (herein referred to as "non-axial motion") as it moves along the bar path through the reducing mechanisms.

Guides:

A single hot steel rolling line normally produces bars with a range of different diameters. For example, a single hot rolling bar mill could produce bars with diameters ranging from 5 mm to 25 mm. The cost of changing the line to produce a bar with a different diameter from the one currently being rolled is partly a function of the number of different pieces of equipment that have to be changed in order to produce the new diameter.

Steel mills use devices (herein referred to as "guides") to control the bar's motion. The guides have a guidance path (herein referred to as the "guidance path") that acts to constrain the motion of the bar and force it onto the bar path. The diameter of the guidance path cannot be either smaller, or much larger, than the diameter of the bar or the guide will not function properly. In short, the diameter of the guidance path and the diameter of the bar must closely match each other so that there is a proper fit between the bar and the guide to insure proper functionality of the guide.

When the mill decides to roll a new bar having a diameter smaller than the diameter of the guidance path on the existing guides, the mill must exchange the existing guides for different guides having a guidance path diameter matching the diameter of the new bar.

To reduce the cost and time required to roll different bar sizes, mills use guides that have a guidance path that is large enough to accommodate a range of bar diameters. This permits one guide to handle more than one size bar and therefore minimizes the number of times the mill must exchange guides. However, mills must make a difficult trade-off to both minimize costs and maintain productivity and quality.

If the size range of the guide is too narrow, more guide changes will be required and there will be a greater possibility of undesirable scratches on the bar surface from contact between the bar and the guide. But, if the size range is too wide, a guide will not be function well and undesirable bar motion will occur.

Cobbles:

Furthermore, if the leading end of the bar is not aligned with the guidance path ("bar misalignment") when the bar enters the guide, the bar will physically collide with the guide. A collision between the bar and the guide significantly increases the amount of friction on the bar, causing the leading end to lose momentum. At the same time that the leading end slows, the rear part of the bar continues to move at the original bar speed. This creates stress on the inside of the bar. Not infrequently, the bar buckles as a consequence. If the bar buckles, the linear motion of the bar stalls. In hot rolled bar mills, this buckling phenomenon is referred to as a "cobble."

Cobbles can also occur if the leading end of the bar is not properly aligned with the entry to the subsequent device, such as a roll stand or a guide, when the bar approaches the subsequent device. This can result in a collision between the bar and the device. When the bar collides with the device, it can buckle and result in a cobble. Cobbles are wasteful and can be dangerous to both personnel and equipment located near the cobble event because of the heat, motion and mass of the bar.

Surface Quality:

The quality of the surface finish of a bar can be very important to the end-user of the bar product. Many users pay a premium price for bar with high surface quality. Instruments such as eddy current and optical sensors are used in-line at bar mills for quality assurance to detect surface defects on bar as it is being produced. The amount of non-axial motion of the bar affects the detection capability of these sensor devices. Therefore, to enable both eddy current and optical sensors to operate more effectively, guides are used in front of these sensors to minimize the amount of the non-axial movement of the bar.

Bar End Capture:

In order for the guide to function properly, it must first physically capture the leading end of the bar ("leading end") as it approaches and enters the guide and second it must direct the leading end onto the guidance path. If the opening to the guide is relatively small, the leading end of the bar may not line up properly with the opening and the bar may cobble. To avoid the potential of cobbling, some existing art employs active control systems to control the guides to capture the leading end of the bar. These systems allow the guides to be disengaged from the bar path by actuators, such as pneumatic arms, when the leading end approaches the entry to the guide. Once the leading end is in the guide, the actuators bring the guide into position and engage the guide with the bar. Even with this technique, the guides may still need to be changed frequently to accommodate the tolerances required by different bar sizes.

Prior Art Guide Designs:

Prior art involves a number of different guide designs meant to accomplish some, or all, of the following objectives: (1) to capture the leading end of the bar and (2) to constrain the non-axial motion of the bar. Prior art also frequently attempts to minimize the friction between the bar and the guide and to cool the guide. These guides have a guidance path with a constant diameter.

The simplest guide is a one-piece design illustrated in FIG. 3. The guide is used to constrain the motion of the bar (FIG. 3, item 10), traveling from left to right through the guide. (FIG. 3, item 122.) This diameter must be large enough to accommodate the bar being processed but small enough that the bar moves in the desired manner along the bar path. The guide has an opening that is larger than the guidance path. The inlet angle θ (FIG. 3, item 124) is typically set between 15° and 30° such that the leading end of the bar can be forced onto the desired bar path. One or more such guides can be arranged together to function in tandem. The bar is forced by the guide opening to move onto the desired bar path. This design is efficient at capturing the leading end of the bar and at constraining the non-axial motion of the bar, but does not efficiently minimize the friction between the bar and the guide. Further, these guides are not always easy to align and may not be easy to inspect and maintain due to the limited visual access to their inner diameter surfaces.

A second type of guide has a fixed lower portion and a re-movable upper portion, item 120' in FIG. 4. The parting line (FIG. 4, item 126) divides the upper and lower portions of the guide. A mechanism, such as a C clamp, is employed to lock the two pieces together to form the guide. The re-moveable upper portion of the guide permits access for maintenance and inspection purposes. In addition, the fixed lower portion typically incorporates a water system to cool the guide. One or more such guides can be arranged together to function in tandem. These guides have an opening that is larger at the front end to efficiently capture the leading end of the bar and force the bar to move onto the bar path. However, this second type of guide does not efficiently minimize the friction between the bar and the guide and it is still necessary to change guides to accommodate different bar sizes.

A third type of guide, illustrated in FIG. 5, uses two or more roll shaped guides, operating in combination. The guides, item 208, have retaining grooves shown as item 210, which have fixed radii. The sum of the radii of the said retaining grooves equals to diameter of the guidance path formed by the retaining grooves. The guides are mounted on supporting arms, item 206. The guides can rotate on their axles, item 212. Mechanical bearings support the said axles allowing them to rotate easily in order to minimize the friction between the bar and the guides. The supporting arms are mounted to the ground structure, item 200, through supporting joints, item 202.

The supporting arms can be manipulated through actuators, item 204 to change the position of the guides relative to the approaching bar (item 10.) This type of guide can be opened up (FIG. 5 (*a*) item 214) to capture the leading end of the bar, then closed (FIG. 5 (*b*) item 214') once the bar is in the guide.

This guide design allows for water-cooling the guides and for easier maintenance.

Tradeoff:

The current art guide designs force the mill operator to make a tradeoff between functionality, i.e. controlling the motion of the bar, and the cost of such functionality, i.e. deciding on the number of guide exchanges that need to be made to achieve such functionality. Guide exchanges take time and require labor. The more guide exchanges required, the higher the mill's operating costs. Closer tolerances between the diameter of the guidance path and the diameter of the bar enhance the guide's functionality. Closer tolerances mean that the guide better serves its main purpose of controlling the motion of the bar. However, if the tolerance is very tight, the mill will have to exchange guides more frequently, and incur more costs, whenever it changes the size of the bar being processed. On the other hand, if the tolerance is set too loose in order to minimize the need for guide exchanges and hence costs, the non-axial motion of the bar will not be as well constrained and the functionality of the guide will be compromised.

In addition, prior art is based on applying force through contact between the guide and the bar to control the non-axial motion of the bar. Such contact, particularly when there is high bar speed and tight bar diameter constraints, has the potential to negatively affect the surface quality of the bar being rolled.

OBJECT OF THE INVENTION

It is one object of the present invention to overcome one or more of the aforementioned problems associated with existing approaches to control the bar's non-axial motion and to force the bar onto a predetermined bar path.

SUMMARY OF THE INVENTION

The present invention is a guide, comprised of two or more rotatable retaining elements. The said retaining elements have variable retaining groove radii. The said radii of the retaining grooves combine to form a guidance path with a variable diameter. The diameter of the said guidance path can be determined for each particular orientation of the retaining elements.

The invention is intended for use in a manufacturing process, such as hot steel bar rolling, to control the bar's non-axial motion and constrain the bar to a predetermined bar path. The position of each of the said retaining elements relative to each other and to the bar path is designed to properly align the bar with the desired bar path. The invention includes a bearing, comprised of a media such as compressed air, oil or water, to support the bar as it travels through the guide and to prevent the bar from coming in contact with the surface of the guide.

The unique advantages of the present invention are as follows: (1) It eliminates the need to physically exchange one guide for a different sized guide during a bar size change. Rotating the retaining elements causes the radii of the retaining grooves, and hence the diameter of the guidance path, to change. The mill operator can determine the guidance path diameter desired and then rotate the said retaining elements to the appropriate orientation where their radii form a guidance path matched to the desired diameter. Rotating the invented guide accomplishes the same thing as physically changing guides does, namely it changes the diameter of the guidance path. (2) The invention also employs a bearing, comprised of a media such as compressed air, or water, to prevent physical contact between the guidance path and the bar. This bearing eliminates or reduces a source of surface damage to the bar.

PREFERRED EMBODIMENT DESIGN

Figure 1:
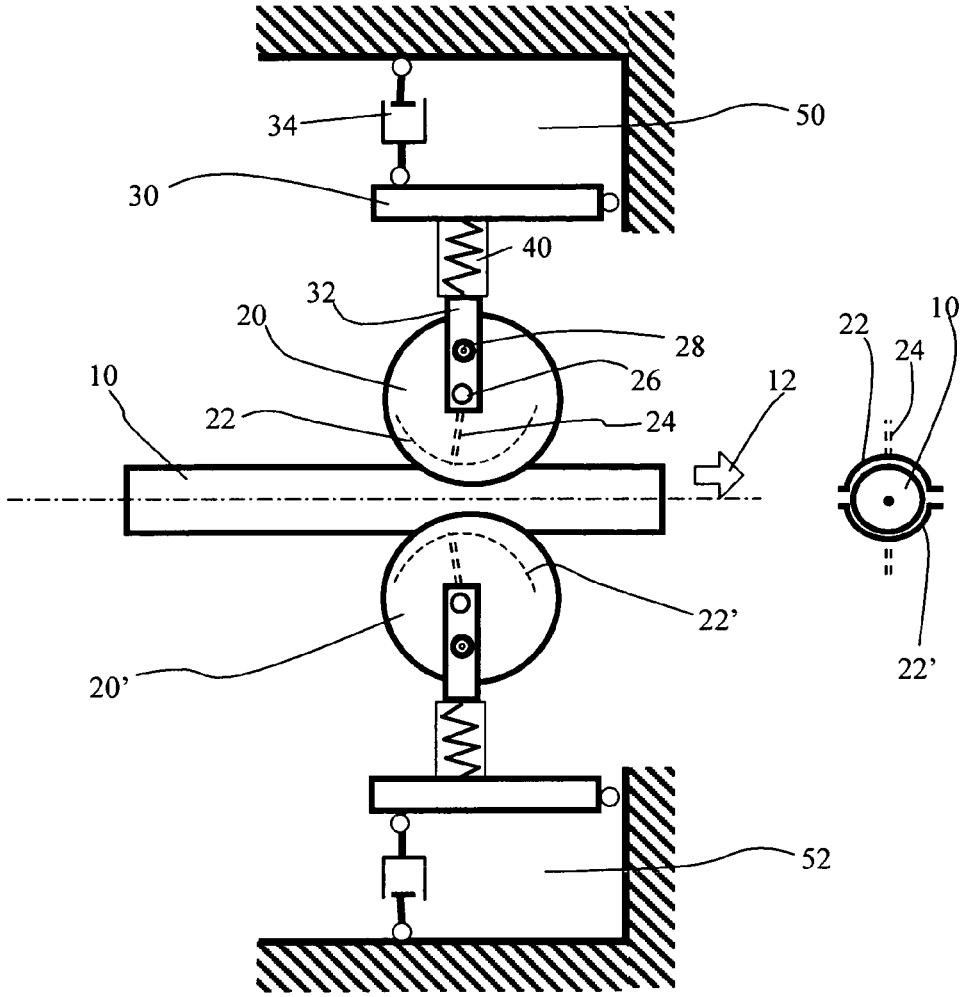
FIG. 1. Schematic of the present invention guiding a bar.
Figure 2:
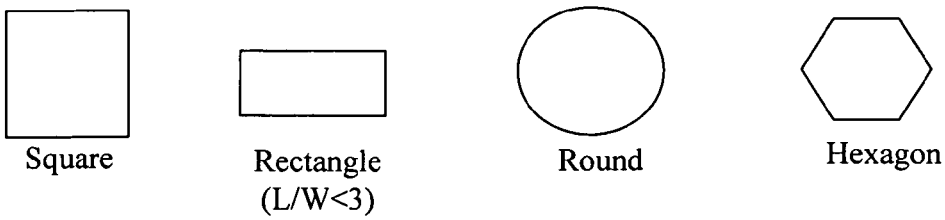
FIG. 2. Examples of bars of various shapes.
Figure 3:
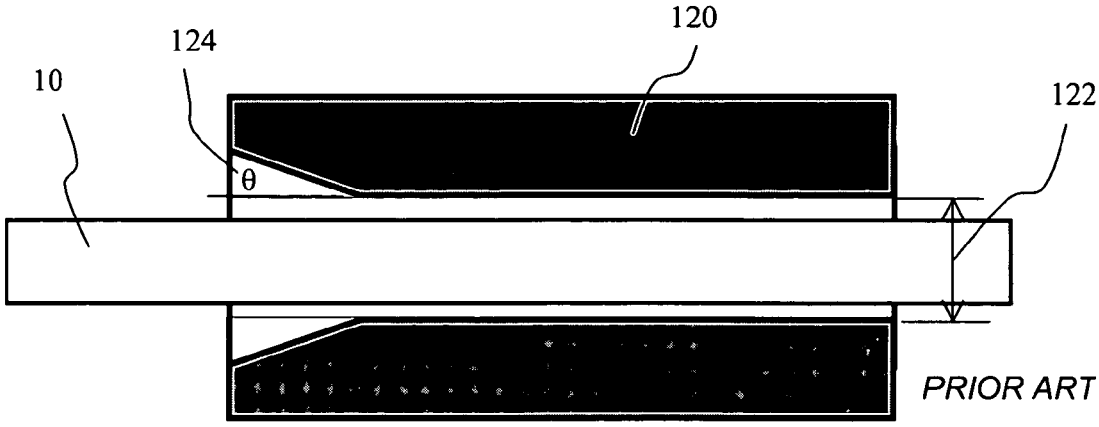
FIG. 3. Schematic of an example of the prior art.
Figure 4:
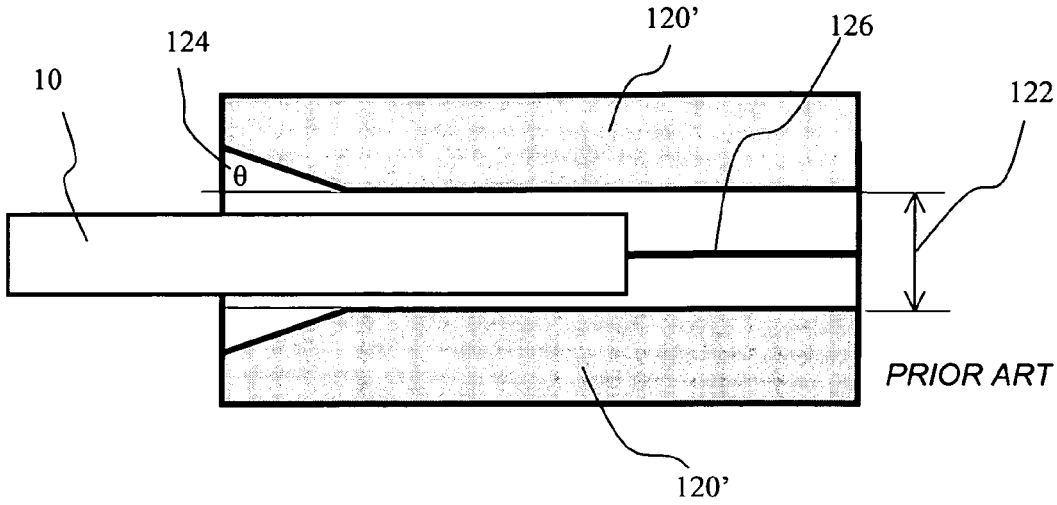
FIG. 4. Schematic of another example of the prior art.
Figure 5:
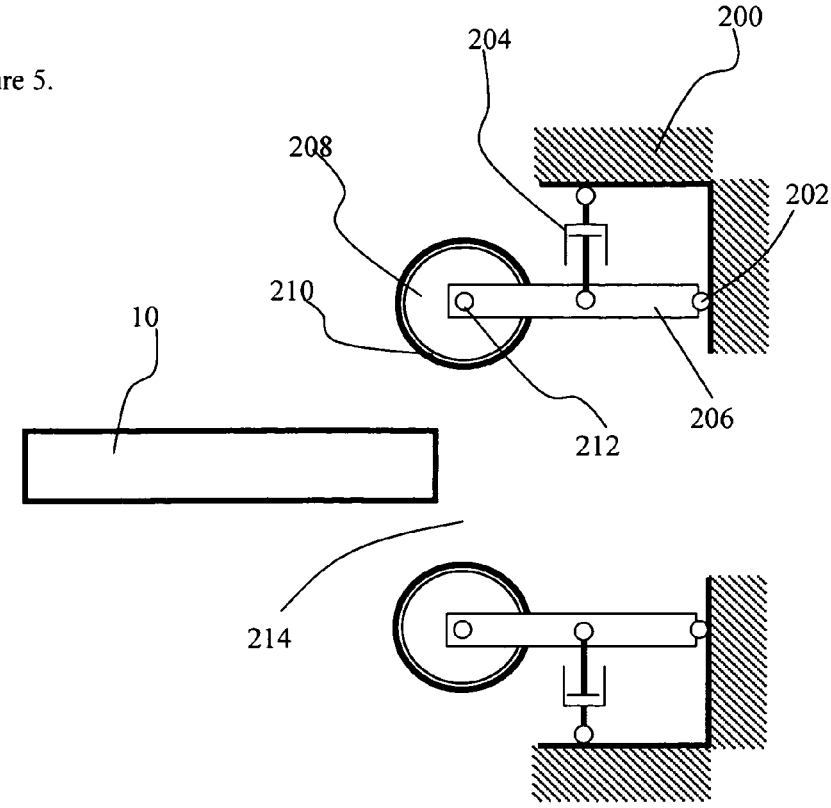
FIG. 5. Schematic of another example of the prior art.
Figure 5:
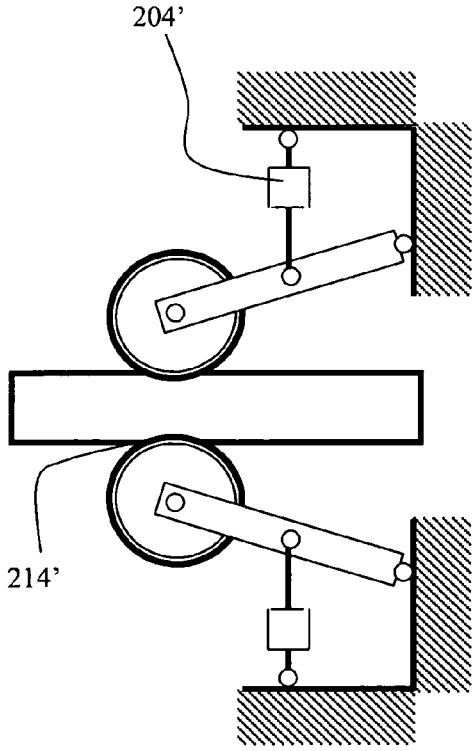

The preferred implementation of this invention is illustrated in FIG. 1. All items noted in the preferred embodiment design described below refer to FIG. 1 unless otherwise specifically stated. The guide illustrated in FIG. 1 is comprised of a combination of two identical mechanisms illustrated by items 50 and 52. The bar (item 10) travels in the direction shown by the arrow (item 12) and is constrained by the guide. FIG. 1 shows the guide's retaining elements, illustrated by items 20 and 20', (herein called the "retaining elements.")

The retaining elements may be in the shape of a full, semi or partial disk. The retaining elements have retaining grooves items 22 and 22' (herein called the "retaining grooves.") machined along their perimeter surfaces. The retaining grooves have variable sized radii. Each retaining element must have enough circular arc length at its perimeter to accommodate machining the intended variable radius range for the retaining grooves. The variable geometry of the retaining grooves is illustrated in item 22 of FIG. 6.

Combined together as illustrated in FIG. 1, the two retaining grooves form a guidance path that acts to constrain the motion of the bar to the desired bar path.

The variable radii of the retaining grooves in this preferred embodiment are designed so they increase continuously from a point of origin to an end point. Those skilled in the art shall know that they need not necessarily increase continuously from a point of origin to an end point. The radii of the retaining grooves can be determined for every location along the retaining grooves.

Adding the said radii of the retaining grooves together at each particular orientation of the retaining elements enables one to calculate the diameter of the guidance path formed by the retaining elements at each such orientation.

Each retaining element is attached to a support assembly, formed by items 30 and 32 (the "support assembly.") Each retaining element can rotate about its center. The said center is illustrated as item 26. The said center contains an axle, such as a pin or a shaft, to support the retaining element. The said axle can be manually turned or can be driven by a motor. Rotating the retaining elements by turning the axle causes the radii of the retaining grooves to change. Changing the radii of the retaining grooves causes the diameter of the guidance path to change. Thus, to change the diameter of the guidance path to a desired size, one merely rotates the retaining elements to the appropriate orientation where the sum of the radii of the retaining grooves forms a guidance path with the desired diameter.

The guide invented and described herein can be used for different diameter bars without the need to physically exchange guides or use guides that don't provide adequate functionality. Simply rotating the retaining elements to the orientation that will optimally match the diameter of the guidance path with the diameter of the bar being processed provides a guide with all the functionality required. Such rotation can be accomplished manually or through automatic control.

The orientation of the retaining elements can be fixed by a locking mechanism in order to maintain the desired diameter match between the bar and the guidance path during the period that the bar moves through the guide. Those skilled in the art shall know that such locking can be accomplished by either locking the retaining elements or by locking the axle of each retaining element.

Those skilled in the art shall also know that rotation of the retaining elements can be accomplished either by putting the actuating force directly onto the retaining elements or by applying it to the axle (item 26.)

To prevent the bar from physically contacting the retaining grooves, a medium such as compressed air is delivered through openings in the retaining grooves to the contact area between the bar (item 10) and the retaining grooves (items 22 and 22'). The said air is delivered to the openings through piping or channels in the retaining element support assembly, formed by items 30 and 32 (the "support assembly.") The said air and the retaining grooves act together to create an air bearing (the "air bearing") to support the bar as it passes through the guide. The air bearing prevents the bar from physically contacting the surface of the retaining elements.

Those skilled in the art shall know that the compressed air piping can be either flexible or fixed and can be composed of metal or plastic materials. Those skilled in the art shall also know that the said medium can be other types of fluid such as water or oil.

The support assembly can be attached to an actuator (item 34) such that the retaining elements can be automatically disengaged from the bar path and then engaged to the bar as the leading end enters the guide.

In some cases it might be desirable to control or dampen the vibrations of the bar as it moves along the bar path. Doing so might stabilize the bar so that sensors may operate more effectively and/or cobbles may be avoided. If so desired, as an alternative to a fixed mounting system, the support assembly could incorporate a vibration damping mechanism (the "damping mechanism"), as illustrated in item 40. The damping mechanism could be adjustable to deal with various vibration control needs. Those skilled in the art shall know that the damping mechanism can be comprised of various components. For instance, the damping mechanism could be a simple combination of a spring and a damper, with the spring coefficient and the damping coefficient capable of being adjusted by the operator. The damping mechanism could also be an active vibration-damping device, such as a piezoelectric device designed to automatically react to the vibration motion and provide energy dissipation to dampen the vibration of the bar.

Figure 6:
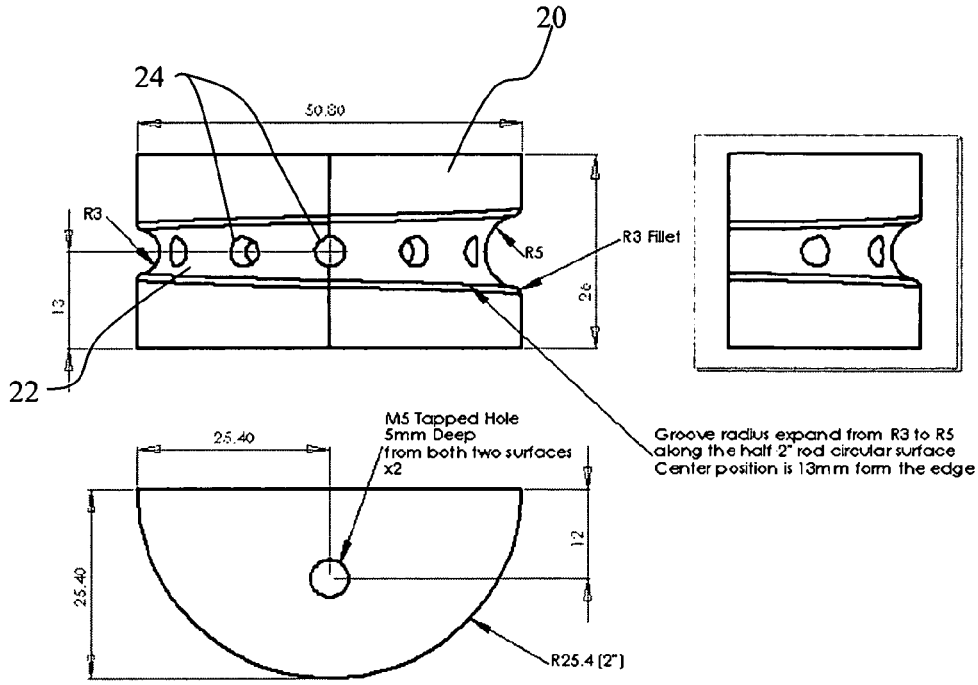
FIG. 6. The top surface of a retaining element (item 20) described in the present invention showing (a) a retaining groove (item 22) where the radii of the retaining groove increases in size from the left side (R3) to the right side (R5) of the retaining groove and (b) the openings (item 24) in the retaining groove (item 22) allow air or other media to enter the guide path.

FIG. 6 is an implementation example of the retaining elements (item 20.) In this example, a retaining groove with a continuously variable radius ranging from 3 mm to 5 mm is implemented. In this case, the variable radius is implemented with a linear, continuous variability. Those skilled in the art shall know that the variable radius can be non-linear and the variable radius can be non-continuous (such as discrete). In this figure, the air path (item 24) is implemented as multiple outlets. Each of the outlets can be individually controlled to selectively open or shut the outlet to achieve the desired airflow. In this implementation, only one air outlet is open to deliver the best air bearing effect.

Figure 7:
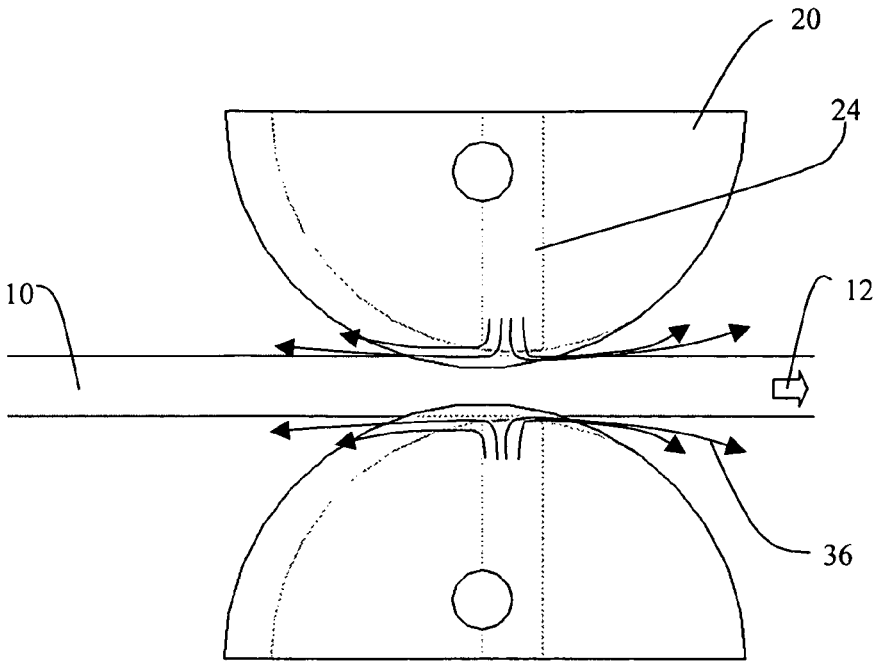
FIG. 7. Schematic shows the air flow (item 36) forming an air bearing to support the bar (item 10) moving through the guide path formed by two retaining elements (item 20.) The air path outlet (item 24) is approximately perpendicular to the bar in this example.

FIG. 7 shows that the airflow (item 36) can be evenly distributed when the outlet is perpendicular or nearly perpendicular to the bar (item 10) surface. However, such perpendicularity is not necessary.

Figure 8:
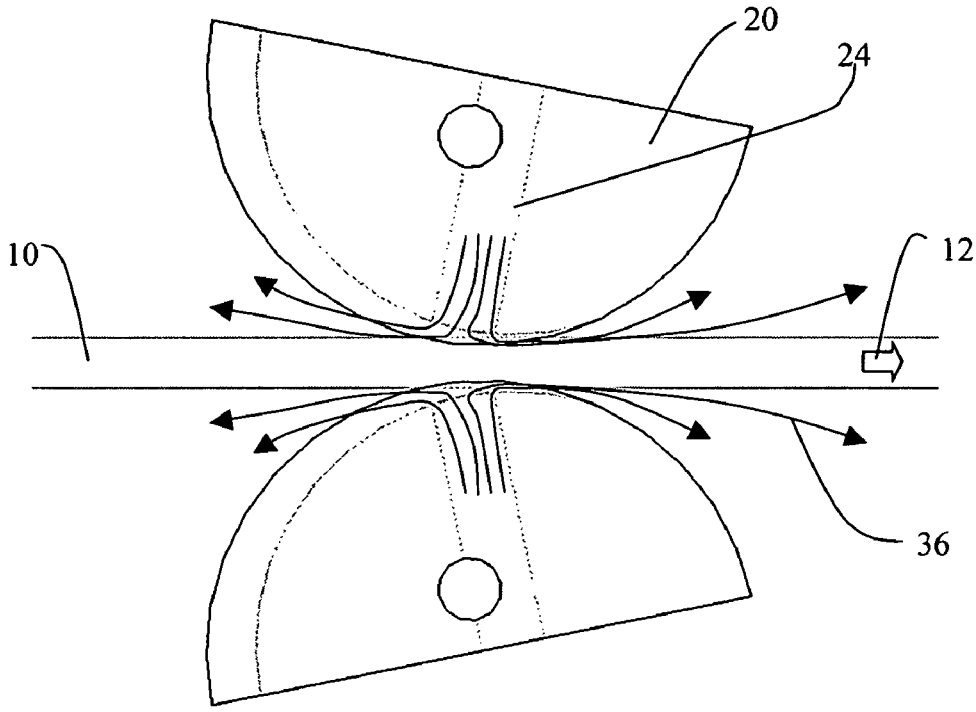
FIG. 8. Schematic where the retaining elements (item 20) have been rotated so that the air path outlets (item 24) for the air flow (item 36) are oriented at a non-perpendicular angle to the bar (item 10.)

FIG. 8 illustrates that the airflow (item 36) will still be distributed evenly when the air path (item 24) is tilted toward the side of the bar (item 10) approaching the air path. This even air distribution is due to the effects of the drag on the airflow created by the linear motion of the bar.

Figure 9:
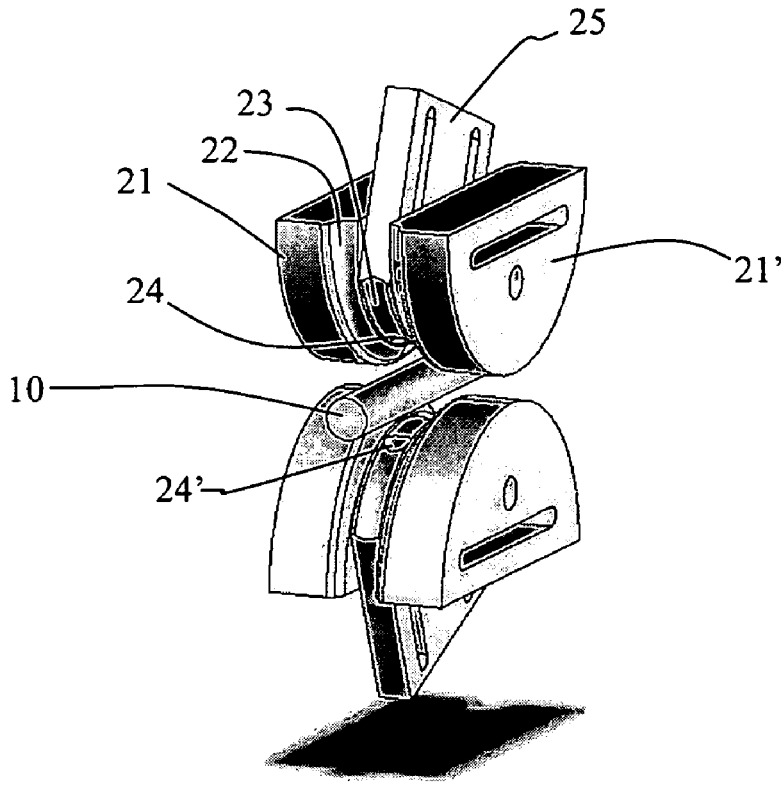
FIG. 9. Schematic of the present invention showing the air path (item 24) in the centerpiece shown as item 25. The retaining element (item 20) is composed of three separate elements: two similar pieces (items 21 and 21') and a centerpiece (item 25.)

FIG. 9 shows another implementation in which the retaining element (item 20) is composed of three separate pieces: two matching pieces, items 21 and 21' and a centerpiece shown as item 25 (the "centerpiece.") The centerpiece is contiguous to items 21 and 21" and contains the air path (item 24.) The centerpiece has a partial retaining groove, item 23, which joins continuously and smoothly with the partial retaining grooves on pieces 21 and 21' to form a unitary retaining groove. In this implementation, pieces 21 and 21' can rotate independent of piece 25 such that the air path (item 24) can be pointed in a direction that is different than the orientation of pieces 21 and 21." This design allows the user the flexibility to adjust the air path for the best air bearing effect, given a particular bar diameter and bar speed.

Figure 10:
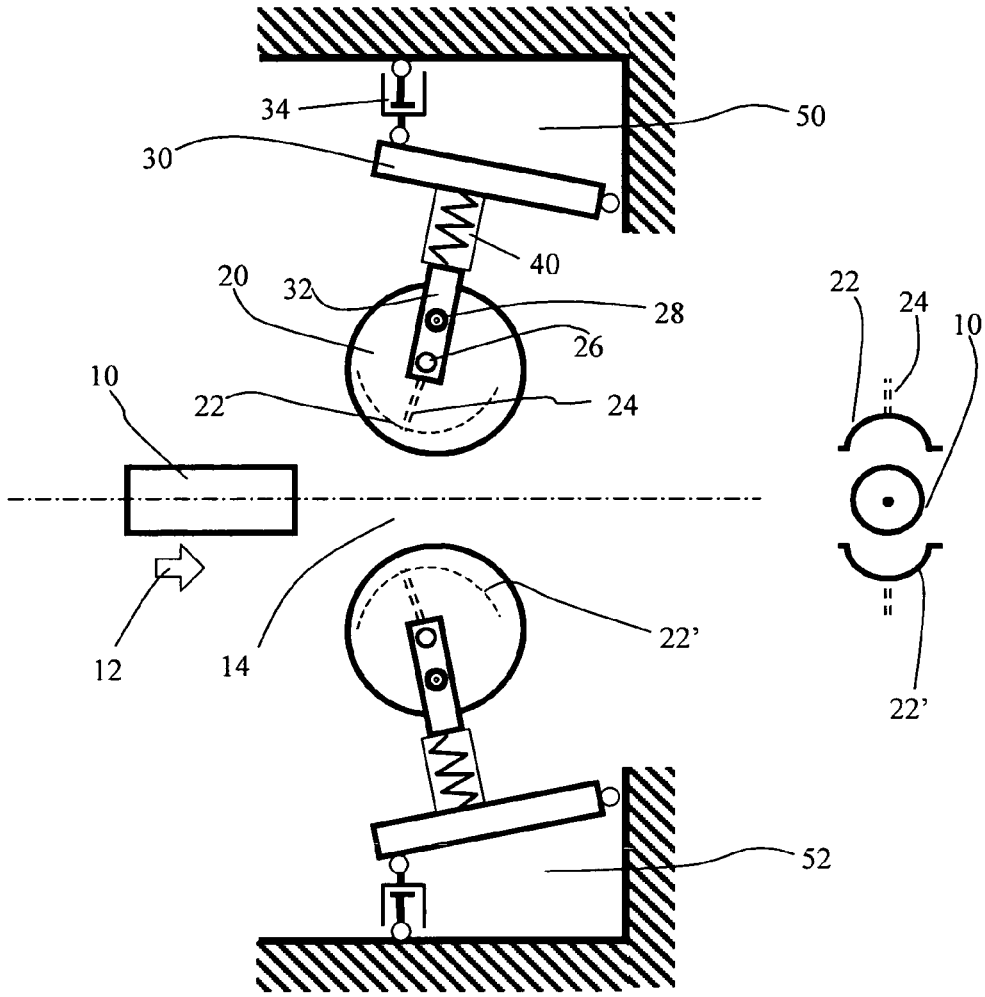
FIG. 10. Schematic of the present invention, showing the guide disengaged (i.e. open) to receive the approaching bar end.

FIG. 10 illustrates how the retaining elements, items 20 and 20' can be open, i.e. disengaged from the bar path when the leading end of the bar (item 10) is approaching the guide. In this case, the actuator (item 34) could retract the retaining elements, such that the opening (item 14) formed by the retaining elements is made larger when the arrival of the leading end of the bar is imminent. Once the leading end of the bar is in the guide, the actuator can return the retaining element to a predetermined position in order to engage the retaining elements with the bar.

Figure 11:
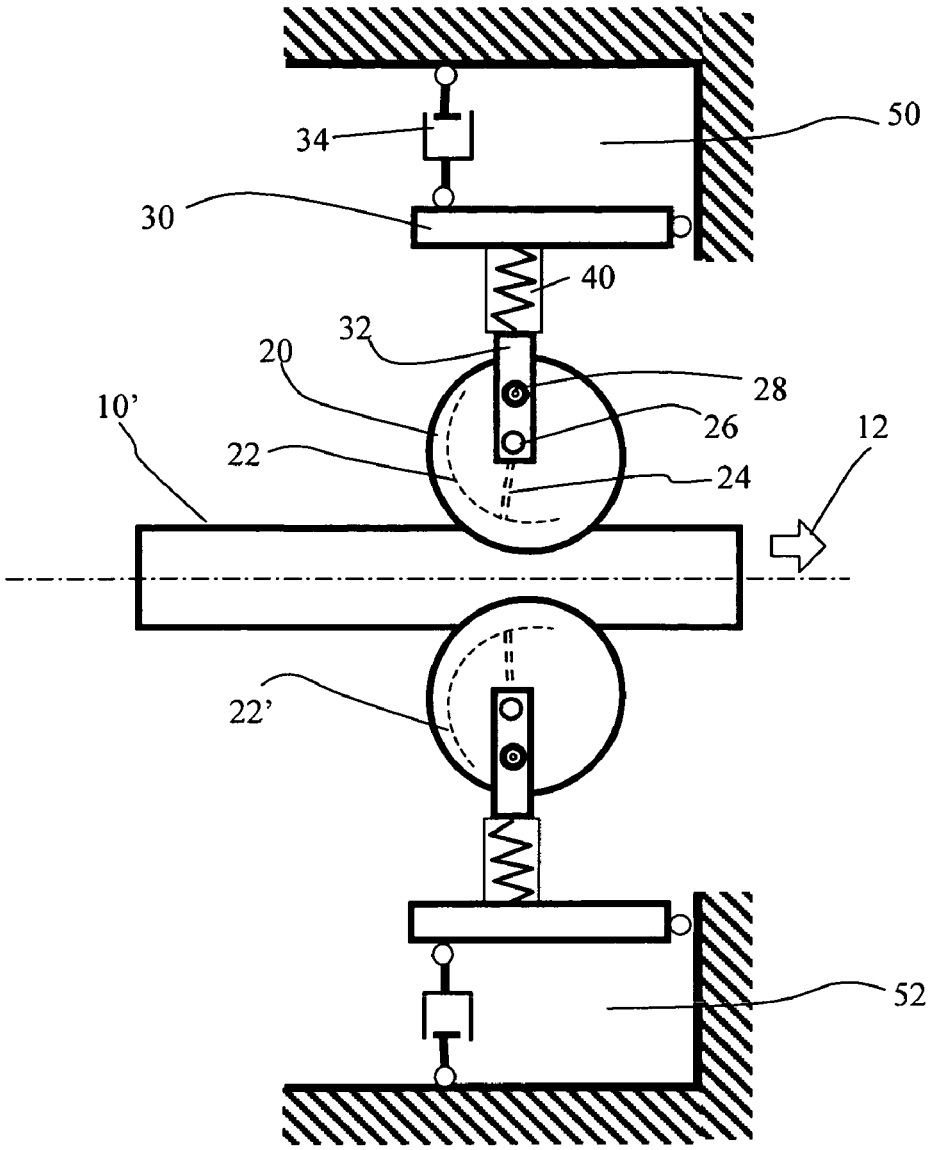
FIG. 11. Schematic of the present invention illustrating that the retaining elements 22 and 22' have been rotated to increase the radii of their retaining grooves and hence the diameter of the guide path in order to match a bar with a larger diameter than the bar in FIG. 1.

FIG. 11 shows a bar with a larger diameter than the bar in FIG. 1 and illustrates how the retaining elements (items 20 and 20') have been rotated to match the diameter of the guidance path to the diameter of the bar being rolled. FIG. 11 shows that the retaining elements have been rotated to an orientation such that the radii of the retaining grooves (shown by the dotted line labeled 22 and 22') are larger than the radii of the retaining grooves shown by the dotted line labeled 22 and 22' in FIG. 1.

One skilled in the art can recognize that an index (the "index") could be developed to correlate precise orientations of the retaining elements with various guidance path diameters. Such an index would simplify the task of determining how to rotate the retaining elements to match the radii of the guidance grooves and hence the diameter of the guidance path to a new bar with a different diameter. For example, if the next bar to be rolled has a diameter of 5.5 mm, the index could tell the user to set the retaining elements at an orientation called, for purposes of this example, "Position 1." Rotating the retaining elements to Position 1, so that the combined radii of their retaining grooves creates a guidance path with a diameter a little large that 5.5 mm, would be a reasonably simple operation One skilled in the art shall know that the process of engaging and disengaging the guide with the bar path and of selecting the right position and rotating the retaining elements to that position could be automated using electronic controls, computers and appropriate software.

The Invention has Four Main Features:

First, the guide can be disengaged (moved out of the bar path) until the leading end of the bar is in the guide. Then, the guide will be engaged to the bar. The engaging/disengaging motion can be manually or automatically controlled.

Second, rotating the retaining elements causes the diameter of the guidance path formed by the retaining elements to change. The mill operator, manually or using an actuator device, can rotate the retaining elements to an appropriate orientation where the diameter of the guidance path and the diameter of the product being rolled are matched. The retaining elements can be locked in a fixed position so they will not move as the bar travels through the guides.

Third, the retaining groove is filled with a medium, such as compressed air, that acts as a barrier to prevent the product from physically contacting the surface of the retaining element. In addition, the media may also cool the surface of the retaining element.

Fourth, each retaining element is attached to a mounting system. Said mounting system can be either fixed or can be flexible. A flexible mounting system is comprised of one or more springs and one or more shock absorbers. The predetermined force neutral position of the flexible mounting system is at the bar path. The flexible mounting system dissipates kinetic energy from the bar's lateral motion, thereby reducing the bar's non-axial motion relative to the bar path.

What is claimed is:

1. AN APPARATUS TO CONTROL THE LATERAL MOTION OF A BAR BEING FORMED BY A MECHANICAL PROCESS SUCH AS ROLLING OR DRAWING, comprising:

two or more mechanisms each having rotatable retaining element attached to a mounting system, and each said retaining element has a retaining groove, and each retaining groove has a variable radius, and each said retaining element is configured so that its retaining groove combines with the other said retaining groove(s) to form a guidance path, and the diameter of said guidance path varies according to the radii of said retaining grooves forming the guidance path, and said retaining elements have one or more openings that allow a fluid medium to be introduced into the space between said bar and said retaining elements to support said bar and minimize friction between said bar and said retaining elements, and a means to engage and disengage said retaining elements from the bar path to enable said apparatus to capture an approaching leading end said bar, whereby rotating said retaining elements causes the radii of the retaining grooves to change, and thus changes the diameter of the guidance path, to match the diameter of said bar, so that the lateral motion of said bar can be controlled.

2. The apparatus of claim 1, wherein said mounting system comprises a flexible mounting system attached to each of said retaining elements comprising springs and shock absorbers to dampen the vibrations of the said bar.

3. The apparatus of claim 2 wherein the predetermined force neutral position of said flexible mounting system is at the bar path.

4. The apparatus of claim 3 wherein said flexible mounting system is configured to dissipate kinetic energy from the bar's lateral motion thereby reducing the bar's non-axial motion relative to the bar path.

5. The apparatus of claim 1, wherein said mounting system comprises a flexible mounting system comprised of springs and shock absorbers and each of said springs and shock absorbers can be adjusted in order to control the amount of vibration dampening of the bar.

6. The apparatus of claim 5 wherein said amount of damping is selected so as to increase non-axial stability of the bar for improved operation of sensor-based inspection systems.

7. The apparatus of claim 5 wherein a spring coefficient associated with said springs and a damping coefficient associated with said shock absorbers are adjustable.

8. The apparatus of claim 1 wherein said means to engage and disengage said retaining elements from the bar path to enable said apparatus to capture the approaching leading end of said bar comprises an actuator arm that moves each said retaining element to a respective open position to capture said leading end and a respective closed position to operate as a guide.

9. The apparatus of claim 8 wherein said means to engage and disengage is configured to automatically disengage said retaining elements from the bar path and then engage said retaining elements to the bar as the leading end enters the retaining groove.

10. The apparatus of claim 1 wherein said means to engage and disengage said retaining elements from the bar path is configured to be controlled by an electronic device selected from the group comprising a computer and a PLC (Programmable Logic Control) system.

11. The apparatus of claim 1 wherein said openings contain adjustable valves inserted therein which are configured to control the flow of said fluid medium by adjusting said valves.

12. The apparatus of claim 1 wherein said fluid medium is compressed air forced into said openings by pressure.

13. The apparatus of claim 1 wherein said fluid medium is water forced into said openings by pressure.

14. The apparatus of claim 1 further comprising a computer with installed software configured to control said mounting system.

15. The apparatus of claim 1 wherein the bar comprises one of a steel bar or rod being produced in a hot rolling process.

16. The apparatus of claim 1 wherein said rotatable retaining elements include axle about which said retaining elements can rotate.

17. The apparatus of claim 16 further including a locking mechanism configured to maintain the desired diameter match between the bar and the guidance path.

18. The apparatus of claim 17 wherein said locking mechanism comprises locking the axle of each retaining elements.

19. The apparatus of claim 17 wherein said locking mechanism comprises locking each retaining element.

20. The apparatus of claim 16 further including a motor coupled to said axle for driving said axle to turn, thereby rotating said retaining element.

21. The apparatus of claim 1 wherein said fluid medium is oil.

22. The apparatus of claim 1 further including a damping mechanism configured to dampen vibration of the bar as it moves, said damping mechanism comprising a piezoelectric device configured to automatically react to vibration motion and provide energy dissipation to dampen vibration.

23. The apparatus of claim 1 wherein said variable radius of said retaining elements are adjustable in discrete steps to provide discrete diameters of said guidance path.

24. The apparatus of claim 1 wherein said retaining element comprises a first end-piece, a second end-piece, and a centerpiece configured to be disposed between said first and second end-pieces, said centerpiece containing an air-path opening for carrying compressed air, said centerpiece including a partial retaining groove which joins continuously and smoothly with respective partial retaining grooves on first and second end-pieces, said centerpiece being configured to rotate independently of said first and second end-pieces so as to allow independent adjustment of said air path opening to effect a desired air bearing effect.

25. The apparatus of claim 1 further including indicia operative as an index for facilitations adjustment rotation of said retaining elements to obtain a desired diameter of the guidance groove.

26. The apparatus of claim 1 wherein said fluid medium is one selected from the group comprising compressed air, water, and oil, said selection based on a desired bearing effect and a desired bar cooling effect.

* * * * *